US009476011B2

(12) United States Patent
Letzelter et al.

(10) Patent No.: US 9,476,011 B2
(45) Date of Patent: Oct. 25, 2016

(54) DISHWASHING METHOD

(71) Applicant: The Procter & Gamble Company, Cincinnati, OH (US)

(72) Inventors: Nathalie Sophie Letzelter, Trimdon (GB); Alexander Charles Hollingsworth, Newcastle upon Tyne (GB); Fernando Solache Leon, Newcastle upon Tyne (GB); Victoria Wray, Northumberland (GB); Neil Bradley, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 547 days.

(21) Appl. No.: 13/938,404

(22) Filed: Jul. 10, 2013

(65) Prior Publication Data

US 2014/0053878 A1 Feb. 27, 2014

(30) Foreign Application Priority Data

Aug. 24, 2012 (EP) ..... 12181801

(51) Int. Cl.

| | |
|---|---|
| ***C11D 3/065*** | (2006.01) |
| ***C11D 3/00*** | (2006.01) |
| ***C11D 3/36*** | (2006.01) |
| ***C11D 3/37*** | (2006.01) |
| ***C11D 3/39*** | (2006.01) |
| ***C11D 11/00*** | (2006.01) |
| ***A47L 15/44*** | (2006.01) |
| ***C11D 3/06*** | (2006.01) |

(52) U.S. Cl.

CPC ..... *C11D 3/065* (2013.01); *A47L 15/44* (2013.01); *C11D 3/0036* (2013.01); *C11D 3/06* (2013.01); *C11D 3/361* (2013.01); *C11D 3/378* (2013.01); *C11D 3/3932* (2013.01); *C11D 11/0035* (2013.01)

(58) Field of Classification Search

CPC ..... C11D 3/00; C11D 3/36; C11D 3/39; C11D 11/00; C11D 3/37

See application file for complete search history.

(56) References Cited

U.S. PATENT DOCUMENTS

| | | | | |
|---|---|---|---|---|
| 2006/0079425 | A1* | 4/2006 | Kapur | C11D 3/06 510/220 |
| 2007/0244028 | A1* | 10/2007 | Schirmer-Ditze | C11D 1/62 510/500 |
| 2010/0016203 | A1* | 1/2010 | Warkotsch | C11D 3/2096 510/228 |
| 2012/0264670 | A1* | 10/2012 | Hatzelt | C11D 3/168 510/376 |

FOREIGN PATENT DOCUMENTS

| | | |
|---|---|---|
| WO | WO 2006/060966 A1 | 6/2006 |
| WO | WO 2009/037013 A2 | 3/2009 |
| WO | WO 2011/027170 A2 | 3/2011 |

OTHER PUBLICATIONS

EP Search Report Dated Jan. 31, 2013, 6 Pages.
U.S. Appl. No. 13/938,332, filed Jul. 10, 2013, Letzelter, et al.

* cited by examiner

*Primary Examiner* — Gregory Webb
(74) *Attorney, Agent, or Firm* — Abbey A. Lopez

(57) ABSTRACT

An automatic dishwashing liquor comprising:

a) from about 0.5 to about 10 ppm of orthophosphate expressed as elementary phosphorous;
b) from about 40 to about 600 ppm of a first polymer comprising:
   i) carboxylic acid monomers;
   ii) monomers comprising a sulfonic acid group wherein the monomers comprising a sulfonic acid group represent 10% or less of the polymer on a molar basis;
c) from about 15 to about 150 ppm of a phosphonate;
d) a bleach system comprising bleach and a bleach catalyst; and
e) less than 30 ppm of polyphosphate.

15 Claims, No Drawings

DISHWASHING METHOD

TECHNICAL FIELD

The present invention is in the field of cleaning. In particular, it relates to automatic dishwashing cleaning; more particularly, to an automatic dishwashing liquor and a method of automatic dishwashing using orthophosphate containing water. The liquor and method provide good finishing, in particular plastic finish (lack of filming).

BACKGROUND

Users expect items cleaned in an automatic dishwasher to be not only clean but also clear (i.e. lack of filming and spotting). Cleaning presents a great challenge for the automatic dishwasher formulator. An even bigger challenge seems to be presented by the requirement of providing clear items in automatic dishwashing.

Lack of clarity can be manifested as filming and/or spotting on the surface of the washed items. This problem is more of an issue on transparent or translucent items such as glass and plastic items. The causes of filming and/or spotting are not straight forward. Usually it is a combination of the soils on the items, the components of the detergent and the species present in the water used for the dishwashing process. The complex interaction between all these elements is not well understood, but it is clear that the problem of clarity in automatic dishwashing transparent items remains unsolved.

Polyphosphate has been traditionally used to help with cleaning and shine, however environmental considerations have made the automatic dishwashing formulator to move away from the use of polyphosphate, making the shine issue even more challenging. Polyphosphate is also a contributor on the removal of bleachable stains. The removal of these stains is more difficult in the absence of polyphosphate.

Phosphate chemistry is quite complex. Phosphate can be found in a variety of forms, including orthophosphate and polyphosphate. Polyphosphate can come in different forms: pyro-,tripoly-, tetrapoly- and trimeta-phosphate. Film and/or spot formation related to phosphate seems to be specific to the type of phosphate, as well as the cation associated to the phosphate, i.e., it is not the same if the phosphate is in the form of sodium salt, as for example the phosphate coming from the detergent, or in the form of calcium phosphate (coming from the water). This complexity makes shine one of the most challenging and complex issues in automatic dishwashing.

Polyphosphates and/or orthophosphate are used as corrosion inhibitor by some potable water providers. They work by forming a protective film on the interior surface of pipes. It has now been found that the presence of phosphate and more specifically orthophosphate in the wash water negatively impacts detergent performance and in particular the clarity of transparent washed items.

In view of the above discussion there is a need to provide a method of automatic dishwashing that overcomes all or some of the above mentioned problems.

SUMMARY OF THE INVENTION

According to a first aspect of the invention, there is provided an automatic dishwashing liquor. The liquor is the combination of the wash water coming from the water supply and the detergent delivered into the dishwasher. The liquor comprises orthophosphate preferably coming from the water supply, specifically:

a) from about 0.5 to about 10 ppm of orthophosphate expressed as elementary phosphorous;
b) from about 40 to about 600 ppm of a first polymer comprising:
   i) carboxylic acid monomers;
   ii) monomers comprising a sulfonic acid group;
   wherein the monomers comprising a sulfonic acid group represent 10% or less on a molar basis of the polymer;
c) from about 15 to about 150 ppm of a phosphonate;
d) a bleach system comprising bleach and a bleach catalyst; and
e) less than 30 ppm, preferably less than 10 ppm and more preferable less than 5 ppm and especially less than 1 ppm of polyphosphate.

As discussed herein above orthophosphate is sometimes added to the water supply to prevent pipe corrosion and it has a detrimental effect on automatic dishwashing in particular on filming and spotting of the washed items. This detrimental effect is more acute when the detergent used does not contain polyphosphate.

It has been found that washing liquors containing the first polymer in the claimed levels provide excellent cleaning, in particular plastic washed items, present very little if any filming and/or spotting.

In one embodiment of the invention the carboxylic acid is selected from acrylic acid, maleic acid, itaconic acid, methacrylic acid, ethoxylate esters of acrylic acids and mixtures thereof. Preferably the carboxylic acid monomers are acrylic and maleic acids.

In another embodiment of the invention the sulfonic acid group is 3-allyloxy-2-hydroxy-1-propanesulfonate. Especially preferred for use herein are polymers comprising acrylic acid and maleic acid and 3-allyloxy-2-hydroxy-1-propanesulfonate. Washing liquors comprising these polymers provide outstanding cleaning and lack of filming and spotting.

In a preferred embodiment the phosphonate of the dishwashing liquor is 1-hydroxyethane-1,1-diphosphonic acid and/or the salts thereof (HEDP). Good cleaning and shine are obtained when the washing liquor comprises HEDP.

In another preferred embodiment the bleach is an oxygen bleach, in particular percarbonate and the bleach catalyst is a manganese compound. Specially preferred are complexes of manganese with 1,4,7-trimethyl-1,4,7-triazacyclo-nonane (Me3-TACN) or 1,2,4,7-tetramethyl-1,4,7-triazacyclononane (Me4-TACN), in particular Me3-TACN. Also specially preferred is manganese (II) acetate tetrahydrate.

In another embodiment the liquor comprises carbonate. Carbonate could cause filming and spotting on items, however the liquor of the invention seems to prevent the formation of residues on washed items.

In another preferred embodiment the liquor of the invention comprises a non-phosphate builder selected from citric acid, MGDA (methyl-glycine-diacetic acid), GLDA (glutamic-N,N-diacetic acid) and mixtures thereof.

In other embodiments the liquor of the invention comprises a combination of a protease and an amylase, a non-ionic surfactant system, a zinc salt and/or mixtures thereof. Liquors comprising all the above ingredients have been found to provide good results.

Preferably the liquor of the invention is free of sodium chloride. Preferably the liquor of the invention is free of non-sulfonated polymers, i.e., polymer that do not comprise monomers comprising a sulfonic acid groups. The performance of the liquor of the invention is such that it does not require the presence of other polymers. In particular the liquor is free of polyethylene imine containing polymers.

In preferred embodiments the liquor comprises a second polymer comprising:

i) carboxylic acid monomers;

ii) monomers comprising a sulfonic acid group;

wherein the monomers comprising a sulfonic acid group represent more than 10%, preferably at least 20% and preferably less than 90%, more preferably less than 60% on a molar basis) of monomers comprising a sulfonic acid. The second polymer seems to help to eliminate filming and/or spotting on glass items. Thus liquors comprising a combination of the first and second polymer provide outstanding shine benefits on loads comprising items comprising a variety of materials, such as glass, metal and plastic.

According to another aspect of the invention, there is provided a method of washing a dishware load, preferably comprising plastic items, in an automatic dishwasher in the presence of orthophosphate, the method comprising the steps of subjecting the load to the dishwashing liquor of the invention.

According to the last aspect of the invention there is provided a method of washing a dishware load, preferably comprising plastic items, in an automatic dishwasher in the presence of orthophosphate, the method comprising the steps of:

1) subjecting the load to wash water comprising from about 0.5 to about 10 ppm of orthophosphate expressed as elementary phosphorous; and
2) providing from about 10 g to about 20 g of an automatic dishwashing composition comprising:
   a) from about 1 to about 15% by weight of the composition of a first polymer comprising:
      i. carboxylic acid monomers;
      ii. monomers comprising a sulfonic acid group; wherein the monomers comprising a sulfonic acid group represent 10% or less of the polymer on a molar basis;
   b) from about 0.5 to about 5% by weight of the composition of a phosphonate;
   c) a bleach system comprising bleach and a bleach catalyst; and
   d) less than 1% of polyphosphate.

DETAILED DESCRIPTION OF THE INVENTION

The present invention envisages an automatic dishwashing liquor comprising orthophosphate and a first polymer comprising carboxylic acid monomers and monomers comprising a sulfonic acid group having a low level (10% or less, preferably less than 8% and preferably more than 2, more preferably more than 4% on a molar basis) of monomers comprising a sulfonic acid. The liquor is substantially free of polyphosphate (comprises less than 30 ppm, preferably less than 10 ppm and more preferably less than 1 ppm of polyphosphate), i.e., the detergent composition used to make the dishwashing liquor does not have polyphosphate purposely added. The automatic dishwashing liquor leaves the washed items, in particular plastic items, free of filming and spotting. There is also provided a method of automatic dishwashing in the presence of orthophosphate. The method provides excellent clarity on plastic items.

The washing liquor comprises preferably from about 0.5 to about 10 ppm, more preferably from about 0.8 to about 5 ppm and especially from about 1 to about 2 ppm of orthophosphate expressed as elementary phosphorous. Preferably the orthophosphate comes from the water supply.

First Polymer

The first polymer comprises carboxylic acid monomers and monomers comprising a sulfonic acid group, either in its acid form or as a salt. The polymer can optionally comprise other monomers, such as other ionic or non-ionic monomers. Preferably the polymer is free of other monomers. The polymer must have 10% or less, preferably 10%, preferably more than 1% and more preferably more than 4% on a molar basis, of monomers comprising a sulfonic acid group. This level of monomer comprising sulfonic acid groups seem to confer the polymer its capacity to ameliorate the filming and spotting caused by orthophosphate species, in particular on plastic objects.

The liquor of the invention comprises from about 40 to about 600 ppm, preferably from 50 to 500 ppm and more preferably from 60 to 400 ppm of a of the first polymer.

An automatic dishwashing composition useful for the liquor and method of the invention should comprise the first polymer in a level of from about 0.01% to about 20%, preferably from 0.1% to about 15%, more preferably from 0.5% to 10% by weight of the composition.

The first polymer comprises (i) at least one structural unit derived from at least one carboxylic acid, preferably an unsaturated carboxylic having the general formula (I):

$$R^1(R^2)C{=}C(R^3)COOH \quad (I)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (I), acrylic acid ($R^1{=}R^2{=}R^3{=}H$), methacrylic acid ($R^1{=}R^2{=}H;R^3{=}CH_3$) and/or maleic acid ($R^1{=}COOH;R^2{=}R^3{=}H$) are particularly preferred. The carboxylic acid groups can be neutralized.

The first polymer optionally comprises one or more structural units derived from at least one nonionic monomer having the general formula (II):

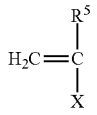

(II)

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

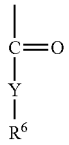

(III)

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

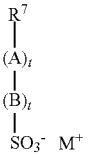

(IV)

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Monomers containing sulfonic acid groups correspond to formula (V):

$$R^5(R^6)C{=}C(R^7){-}X{-}SO_3H \quad (V)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—

Preferred carboxylic acid monomers include one or more of the following: acrylic acid, maleic acid, itaconic acid, methacrylic acid, ethoxylate esters of acrylic acids and mixtures thereof. Acrylic and maleic acids being more preferred.

Suitable sulfonic acid groups include the followings: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy) propanesulfonic acid, 2-methyl-2-propene-1-sulfonic acid, styrene sulfonic acid, vinylsulfonic acid,3- sulfopropyl acrylate, 3-sulfopropyl methacrylate, sulfomethylacrylamid, sulfomethylmethacrylamide, and water soluble salts thereof. Most preferably the unsaturated sulfonic acid monomer is 3-allyloxy-2-hydroxy-1-propanesulfonate.

If present, preferred non-ionic monomers include one or more of the following: methyl (meth)acrylate, ethyl(meth) acrylate, t-butyl(meth)acrylate, methyl(meth)acrylamide, ethyl (meth)acrylamide, t-butyl(meth)acrylamide, styrene, or α-methyl styrene.

Preferably the first polymer comprises acrylic acid and maleic acid and 3-allyloxy-2-hydroxy-1-propanesulfonate. Preferably the molecular weight of the second polymers is from about 5,000 to about 15,000 Da. First polymers suitable for use herein is described in WO2009/060966, especially preferred for use herein being the polymer described in example 1.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Second Polymer

The second polymer comprises carboxylic acid monomers and monomers comprising a sulfonic acid group, either in its acid form or as a salt. The polymer can optionally comprise other monomers, such as other ionic or non-ionic monomers. Preferably the polymer is free of other monomers. The polymer must have more than 10%, preferably more than 12%, more preferably more than 15% and less than 50%, more preferably less than 40% on a molar basis, of monomers comprising a sulfonic acid group. This level of monomer comprising sulfonic acid groups seem to confer the polymer its capacity to ameliorate the filming and spotting caused by orthophosphate species, in particular on glass and metal objects. The second polymer can have the monomers described for the first polymers but the level of monomers comprising a sulfonic acid groups is higher.

In preferred embodiments, the liquor of the invention comprises from about 40 to about 600 ppm, preferably from 50 to 500 ppm and more preferably from 60 to 400 ppm of the second polymer.

An automatic dishwashing composition useful for the liquor and method of the invention could comprise the second polymer in a level of from about 0.01% to about 20%, preferably from 0.1% to about 15%, more preferably from 0.5% to 10% by weight of the composition.

Suitable second polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

Especially preferred for use herein as second polymer is a polymer comprising acrylic acid and 2-acrylamido-2-methylpropane sulfonic acid (AMPS) such as Acusol 588 sourced from Rohm and Haas.

Phosphonate

Phosphonates Suitable for Use Herein Include:

a) aminotrimethylenephosphonic acid (ATMP) and/or the salts thereof;
b) ethylenediaminetetra(methylenephosphonic acid) (EDTMP) and/or the salts thereof;
c) diethylenetriaminepenta(methylenephosphonic acid) (DTPMP) and/or the salts thereof;
d) 1-hydroxyethane-1,1-diphosphonic acid (HEDP) and/or the salts thereof;
e) 2-phosphonobutane-1,2,4-tricarboxylic acid (PBTC) and/or the salts thereof;
f) hexamethylenediaminetetra(methylenephosphonic acid) (HDTMP) and/or the salts thereof;
g) nitrilotri(methylenephosphonic acid) (NTMP) and/or the salts thereof; and
h) mixtures thereof.

Dishwashing liquors which contain 1-hydroxyethane-1,1-diphosphonic acid (HEDP) as phosphonate are particularly preferred according to the invention. It is preferably used as a sodium salt, the disodium salt exhibiting a neutral reaction and the tetrasodium salt an alkaline (pH 9) reaction.

The liquor of the invention comprises from about 15 to about 150 ppm, preferably from about 20 to about 120 ppm, more preferably from about 25 to about 80 ppm of a phosphonate, preferably HEDP.

An automatic dishwashing composition useful for the liquor and method of the invention should comprise a phosphonate in a level of from about 0.01% to about 5%, preferably from 0.1% to about 3%, more preferably from 0.5% to 2% by weight of the composition.

Bleach System

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ϵ-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Preferably, the level of bleach in compositions suitable to generate the liquor of the invention or for use in the method of the invention is from about 1 to about 20%, more preferably from about 2 to about 15%, even more preferably from about 3 to about 12% and especially from about 4 to about 10% by weight of the composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in compositions to use in the liquor of the invention are in a level of from about 0.01 to about 10%, preferably from about 0.1 to about 5% and more preferably from about 1 to about 4% by weight of the total composition.

Bleach Catalyst

The dishwashing liquor of the invention contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16.

Suitable catalysts for use herein include cobalt (III) catalysts having the formula:

$$Co[(NH3)nMmBbTtQqPp]Yy$$

wherein cobalt is in the +3 oxidation state; n is an interger from 0 to 5 (preferably 4 or 5; most preferably 5); M represents a monodentate ligand; m is an integer from 0 to 5 (preferably 1 or 2; most preferably 1); B represents a bidentate ligand; b is an integer from 0 to 2; T represents a tridentate ligand; t is 0 or 1; Q is a tetradentae ligand; q is 0 or 1; P is a pentadentate ligand; p is 0 or 1; and $n+m+2b+3t+4q+5p=6$; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts have the formula:

$$[Co(NH3)n(M)m]Yy$$

wherein n is an interger from 3 to 5 (preferably 4 or 5; most preferably 5); M is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); $m+n=6$; and Y is an appropriately selected counteranion present in a number y, which is an integer from 1 to 3 (preferably 2 to 3; most preferably 2 when Y is a −1 charged anion), to obtain a charge-balanced salt.

The most preferred cobalt catalyst useful herein has the formula [Co(NH3)5Cl]Yy., and especially [Co(NH3)5Cl]Cl2.

Suitable M, B, T, Q and P ligands for use herein are known, such as those ligands described in U.S. Pat. No. 4,810,410, to Diakun et al, issued Mar. 7, 1989, In addition, examples of M include pryidine and SCN; examples of B include ethylenediamine, bipyridine, acetate, phenthroline, biimidazole, and tropolone; examples of T include terpyridine, acylhydrazones of salicylaldehyde, and diethylenetriamine; examples of Q include triethylenetetramine, N(CH2CH2NH2)3, Schiff bases (for example HOCH2CH2C═NCH2CH2N═CCH2CH2OH); and examples of P include polyimidazoles and HOCH2CH2C═NCH2CH2NH—CH2CH2N═CCH2CH2OH.

These cobalt catalysts are readily prepared by known procedures, such as taught for example in U.S. Pat. No. 4,810,410, to Diakun et al, issued Mar. 7, 1989, and J. Chem. Ed. (1989), 66 (12), 1043-45; The Synthesis and Characterization of Inorganic Compounds, W. L. Jolly (Prentice-Hall; 1970), pp. 461-3.

Manganese bleach catalysts are preferred for use herein. Especially preferred catalyst for use here is a dinuclear manganese-complex having the general formula:

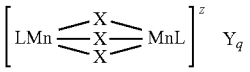

wherein Mn is manganese which can individually be in the III or IV oxidation state; each x represents a coordinating or bridging species selected from the group consisting of H2O, O22-, O2-, OH—, HO2-, SH—, S2-, >SO, Cl—, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y].

Preferred manganese-complexes are those wherein x is either $CH_3COO^-$ or $O^2$ or mixtures thereof, most preferably wherein the manganese is in the IV oxidation state and x is $O^{2-}$ Preferred ligands are those which coordinate via three nitrogen atoms to one of the manganese centres, preferably being of a macrocyclic nature. Particularly preferred ligands are:

(1) 1,4,7-trimethyl-1,4,7-triazacyclononane, (Me-TACN); and (2) 1,2,4,7-tetramethyl-1,4,7-triazacyclononane, (Me-Me TACN).

The type of counter-ion Y for charge neutrality is not critical for the activity of the complex and can be selected from, for example, any of the following counter-ions: chloride; sulphate; nitrate; methylsulphate; surfanctant anions, such as the long-chain alkylsulphates, alkylsulphonates, alkylbenzenesulphonates, tosylate, trifluoromethylsulphonate, perchlorate ($ClO_4^-$), BPh4$^-$, and $PF_6^-$' though some counter-ions are more preferred than others for reasons of product property and safety.

Consequently, the preferred manganese complexes useable in the present invention are:

$$[(\text{Me-TACN})Mn^{IV}(\hat{A}\mu\text{-}0)_3Mn^{IV}(\text{Me-TACN})]^{2+}(PF_6^-)_2 \quad (I)$$

$$[(\text{Me-MeTACN})Mn^{IV}(\hat{A}\mu\text{-}0)_3Mn^{IV}(\text{Me-MeTACN})]^{2+}(PF_6^-)_2 \quad (II)$$

$$[(\text{Me-TACN})Mn^{III}(\hat{A}\mu\text{-}0)(\hat{A}\mu\text{-}OAc)_2Mn^{III}(\text{Me-TACN})]^{2+}(PF_6^-)_2 \quad (III)$$

$$[(\text{Me-MeTACN})Mn^{III}(\hat{A}\mu\text{-}0)(\hat{A}\mu\text{-}OAc)_2Mn^{III}(\text{Me-MeTACN})]^{2+}(PF_6^-)_2 \quad (IV)$$

which hereinafter may also be abbreviated as:

$$[Mn^{IV}{}_2(\hat{A}\mu\text{-}0)_3(\text{Me-TACN})_2](PF_6)_2 \quad (I)$$

$$[Mn^{IV}{}_2(\hat{A}\mu\text{-}0)_3(\text{Me-MeTACN})_2](PF_6)_2 \quad (II)$$

$$[Mn^{III}{}_2(\hat{A}\mu\text{-}0)(\hat{A}\mu\text{-}OAc)_2(\text{Me-TACN})_2](PF_6)_2 \quad (III)$$

$$[Mn^{III}{}_2(\hat{A}\mu\text{-}0)(\hat{A}\mu\text{-}OAc)_2(\text{Me-TACN})_2](PF_6)_2 \quad (IV)$$

The structure of I is given below:

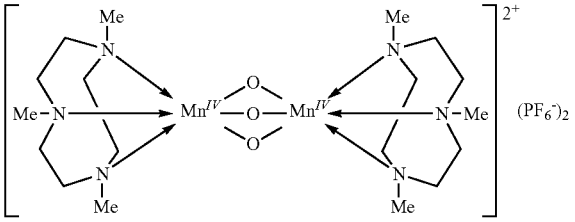

abbreviated as $[Mn^{IV}{}_2(\hat{A}\mu\text{-}0)_3(\text{Me-TACN})_2](PF_6)_2$.

The structure of II is given below:

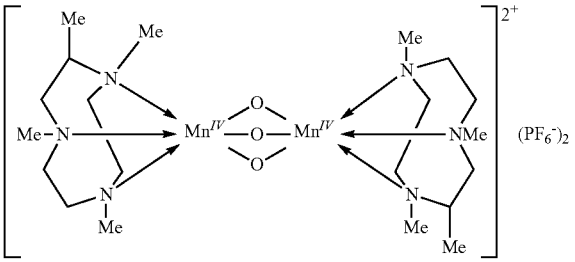

abbreviated as $[Mn^{IV}{}_2(\hat{A}\mu\text{-}0)_3(\text{Me-MeTACN})_2](PF_6)_2$ It is of note that the manganese complexes are also disclosed in EP-A-0458397 and EP-A-0458398 as unusually effective bleach and oxidation catalysts. In the further description of this invention they will also be simply referred to as the "catalyst".

Other suitable bleach catalysts are inorganic compounds (often salts) of manganese (e.g. Mn (II)) include hydrated/anhydrous halide (e.g. chloride/bromide), sulphate, sulphide, carbonate, nitrate, oxide. Further examples of suitable compounds (often salts) of manganese (e.g. Mn (II)) include hydrated/anhydrous acetate, lactate, acetyl acetonate, cyclohexanebutyrate, phthalocyanine, bis(ethylcyclopentadienyl), bis(pentamethylcyclopentadienyl). Most preferably the bleach catalyst comprises manganese (II) acetate tetrahydrate and/or manganese (II) sulphate monohydrate.

The liquor of the invention preferably comprises from about 10 to about 300 ppm, preferably from 20 to 200 ppm and more preferably from 80 to 180 ppm of a of the first polymer.

An automatic dishwashing composition useful for the liquor and method of the invention should comprise the first polymer in a level of from about 0.01% to about 10%, preferably from 0.05% to about 5%, more preferably from 0.5% to 4% by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably compositions suitable for use in the liquor of the invention comprise a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants useful herein include linear and branched compounds having the formula:

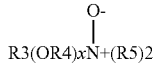

wherein R3 is selected from an alkyl, hydroxyalkyl, acylamidopropoyl and alkyl phenyl group, or mixtures thereof, containing from 8 to 26 carbon atoms, preferably 8 to 18 carbon atoms; R4 is an alkylene or hydroxyalkylene group containing from 2 to 3 carbon atoms, preferably 2 carbon atoms, or mixtures thereof; x is from 0 to 5, preferably from 0 to 3; and each R5 is an alkyl or hydroxyalkyl group containing from 1 to 3, preferably from 1 to 2 carbon atoms, or a polyethylene oxide group containing from 1 to 3, preferable 1, ethylene oxide groups. The R5 groups can be attached to each other, e.g., through an oxygen or nitrogen atom, to form a ring structure.

These amine oxide surfactants in particular include C10-C18 alkyl dimethyl amine oxides and C8-C18 alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are C10-C18 alkyl dimethylamine oxide, and C10-18 acylamido alkyl dimethylamine oxide.

The liquor of the invention preferably comprises from about 50 to about 500 ppm, preferably from 80 to 400 ppm and more preferably from 100 to 300 ppm of surfactant, preferably non ionic surfactant, more preferably a non-ionic surfactant system having a cloud point of from about 20 to about 50° C.

An automatic dishwashing composition useful for the liquor and method of the invention should comprise surfactant in a level of from about 2% to about 20%, preferably from 3% to about 15%, more preferably from 5% to 10% by weight of the composition.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from Bacillus lentus, comprising mutations in one or more, preferably two or more and more preferably three or more of the following positions, using the BPN' numbering system and amino acid abbreviations as illustrated in WO00/37627, which is incorporated herein by reference:V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

G118V+S128L+P129Q+S130A (i)

S101M+G118V+S128L+P129Q+S130A (ii)

N76D+N87R+G118R+S128L+P129Q+S130A+S188D+N248R (iii)

N76D+N87R+G118R+S128L+P129Q+S130A+S188D+V244R (iv)

N76D+N87R+G118R+S128L+P129Q+S130A (v)

V68A+N87S+S101G+V104N (vi)

Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in compositions for use in the liquor of the invention include from about 0.1 to about 10, more preferably from about 0.5 to about 5 and especially from about 1 to about 4 mg of active protease per grams of product.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093, 562), especially those comprising one or more of the following mutations M202, M208, S255, R172, and/or M261, Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, compositions suitable for use in the liquor of the invention comprises at least 0.01 mg of active amylase per gram of composition, preferably from about 0.05 to about 10, more preferably from about 0.1 to about 6, especially from about 0.2 to about 4 mg of amylase per gram of composition.

Additional Enzymes

Additional enzymes suitable for use in compositions for use in the liquor of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Preferably, the protease and/or amylase of the product of the invention are in the form of granulates, the granulates comprise less than 29% of efflorescent material by weight of the granulate or the efflorescent material and the active enzyme (protease and/or amylase) are in a weight ratio of less than 4:1.

Non-Phosphate Builders

Preferred non-phosphate builders include aminocarboxylic builders such as MGDA (methyl-glycine-diacetic acid), GLDA (glutamic-N,N-diacetic acid), iminodisuccinic acid (IDS), carboxymethyl inulin and salts and derivatives thereof. MGDA (salts and derivatives thereof) is especially preferred herein, with the tri-sodium salt thereof being preferred and a sodium/potassium salt being specially preferred for the favourable hygroscopicity and fast dissolution properties when in particulate form.

Other suitable aminocarboxylic builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), IDS (iminodiacetic acid) and salts and derivatives thereof such as N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts and derivative thereof.

In addition to the aminocarboxylic builders the composition can comprise carbonate and/or citrate.

Preferably the liquor of the invention comprises from about 100 to about 800 ppm of carbonate, from about 50 to 500 ppm of an aminocarboxylic acid, preferably MGDA or GLDA and from about 50 to about 500 ppm of citrate.

Preferably builders are present in an amount of from about 10 to about 70, more preferably from about 20 to about 60 and especially from about 35 to about 50% by weight of the composition. Preferably the composition comprises from about 20 to about 60% of carbonate, from about 20 to 40% of an aminocarboxylic acid, preferably MGDA or GLDA and from about 10 to 40% of citrate.

Preferably compositions for use in the liquor and method of the invention are in unit-dose form. Products in unit dose form include tablets, capsules, sachets, pouches, injection moulded compartments, etc. Preferred for use herein are tablets and unit dose form wrapped with a water-soluble film (including wrapped tablets, capsules, sachets, pouches) and injection moulded containers. Preferably the unit-dose form is a water-soluble multi-compartment pack.

ABBREVIATIONS USED IN THE EXAMPLE

In the example, the abbreviated component identifications have the following meanings:

Percarbonate: Sodium percarbonate of the nominal formula $2Na_2CO_3.3H_2O_2$

TAED: Tetraacetylethylenediamine

Cobalt catalyst: Pentaamine acetatocobalt (III) nitrate

Sodium carbonate: Anhydrous sodium carbonate

Polymer 1: Sulfonated polymer as described in Example 1 of WO2009/060966 where the monomers comprising a sulfonic acid group represent 10% of the polymer on a molar basis Polymer 2 Acusol 588. Sulfonated polymer supplied by Rohm & Haas where the monomers comprising a sulfonic acid group represent more than 10% of the polymer on a molar basis NI surfactant: Non-ionic surfactant BTA: Benzotriazole HEDP: 1-hydroxyethyidene-1,1-diphosphonic acid MGDA: methylglycinediacetic acid DPG: Dipropylene glycol In the following examples the levels are quoted in grams.

EXAMPLES

Example 1 shows that the presence of orthophosphate, even in a very low level (0.98 ppm of orthophosphate expressed as phosphorous), in the water used for automatic dishwashing gives rise to filming and spotting on washed items. The filming is considerably worse than in the absence of orthophosphate.

Example 2 shows that wash liquors comprising a composition comprising a polymer comprising carboxylic acid monomers and monomers comprising a sulfonic monomer in a level of 10% on molar basis (Polymer 1) present reduced filming and spotting as compared to wash liquors free or polymer or comprising a polymer comprising carboxylic acid monomers and monomers comprising a sulfonic monomer in a level of more than 10% on molar basis (Polymer 2).

Conditions

The tabulated compositions (A-C) were used to wash six drinking glasses, in Example 1, and two plastic (acrylic) water tumblers, in Example 2 in the presence of a Ballast consisting of 4 black ceramic plates, 1 stainless steel pan, 4 stainless steel spatula, 1 Nylon spatula and two plastic water tumblers (in the case of Example 1) and six drinking glasses (in the case of Example 2). The items were washed in an automatic dishwasher Miele GSL1222, using the 65° C. program. Two types of water were used:

Type #1: Orthophosphate containing water—Hard Water 21 US gpg and 0.98 ppm of orthophosphate expressed as phosphorous (used in Example 1 and 2)

Type #2: Hard Water free or orthophosphate—21 US gpg Hard water was used (20-21 gpg) (used in Example 1).

The washing was performed in the presence of 50 g of the soil as specified below. The drinking glasses and the plastic tumblers are evaluated after they have been subjected to 5 washes.

Soil

A relevant consumer soil is prepared following the below recipe.

| | |
|---|---|
| Water | 35.71 |
| Smash Potato | 0.26 |
| Whole Milk | 2.56 |
| Ketchup | 1.27 |
| Mustard | 1.27 |
| Bisto gravy | 1.27 |
| Margarine | 5.10 |
| Egg Yolk | 2.56 |
| Total (per machine) | 50.00 g |

Products

The compositions tabulated below (given in grams) are introduced into a dual-compartment water-soluble pack having a first compartment comprising a solid composition (in powder form) and a liquid compartment comprising the liquid composition. The water-soluble film used is Monosol M8630 film as supplied by Monosol.

| | A | B | C |
|---|---|---|---|
| Powder | | | |
| Percarbonate | 1.41 | 1.41 | 1.41 |
| TAED | 0.32 | 0.32 | 0.32 |
| Cobalt catalyst | 0.0013 | 0.0013 | 0.0013 |
| Sodium carbonate | 7.20 | 7.20 | 7.20 |
| Sodium Sulphate | 2.8 | 2.8 | 2.8 |
| Amylase | 0.0013 | 0.0013 | 0.0013 |
| Protease | 0.01 | 0.01 | 0.01 |
| Polymer 2 | — | 2.0 | — |
| Polymer 1 | — | — | 2.0 |
| NI surfactant | 0.10 | 0.10 | 0.10 |
| BTA | 0.0080 | 0.0080 | 0.0080 |
| HEDP | 0.10 | 0.10 | 0.10 |
| MGDA | 2.20 | 2.20 | 2.20 |
| Liquid | | | |
| NI surfactant | 1.17 | 1.17 | 1.17 |
| DPG | 0.44 | 0.44 | 0.44 |
| Amine Oxide | 0.05 | 0.05 | 0.05 |
| Glycerine | 0.08 | 0.08 | 0.08 |

Measurement

Washed items (glass or plastic items) are photographed on a stage with a light shining through the sample. The image produced is analysed versus the greyscale and assigned a number to indicate average transmission of light through the sample. The whiter the image the lower the transmission of light through the sample: the blacker the image, the higher the transmission of light through the sample. The number is converted to a percentage scale and called % Clarity.

$$\% \text{ Clarity} = 100 - ((\text{Average Grey Scale Value}/255)*100)$$

Example 1

Effect of Orthophosphate in Water on Glass Clarity After 5 Washes

TABLE 1

| Product A % Clarity | |
|---|---|
| Hard Water | Ortho-P Hard Water |
| 88.85 | 61.25 |

As it can be seen from Table 1 water containing orthophosphate gives rise to less clarity on the washed items (6 drinking glasses), this can be translated into worse filming.

Example 2

Effect of Polymer on Filming on Plastic in the Presence of Orthophosphate

TABLE 2

| % Clarity | | |
|---|---|---|
| Product (B) | Product (A) | Product (C) |
| 34.97 | 23.44 | 57.99 |

As it can be seen from Table 2 the wash liquors containing orthophosphate give rise to more clarity on the washed items (plastic tumblers) when the polymer comprises carboxylic acid monomers and monomers comprising a sulfonic monomer in a level of 10% on molar basis, this can be translated into less filming.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing liquor comprising:

a) from about 0.5 to about 10 ppm of orthophosphate expressed as elementary phosphorous;

b) from about 40 to about 600 ppm of a first polymer comprising:

i) carboxylic acid monomers;

ii) monomers comprising a sulfonic acid group wherein the monomers comprising a sulfonic acid group represent 10% or less of the polymer on a molar basis;

c) from about 15 to about 150 ppm of a phosphonate;

d) a bleach system comprising bleach and a bleach catalyst; and e) less than 30 ppm of polyphosphate.

2. An automatic dishwashing liquor according to claim 1 wherein the carboxylic acid is selected from acrylic acid, maleic acid, itaconic acid, methacrylic acid, ethoxylate esters of acrylic acids and mixtures thereof.

3. An automatic dishwashing liquor according to claim 1 wherein the sulfonic acid group is 3-allyloxy-2-hydroxy-1-propanesulfonate.

4. An automatic dishwashing liquor according to claim 1 wherein the phosphonate is 1-hydroxyethane-1,1-diphosphonic acid and/or the salts thereof.

5. An automatic dishwashing liquor according to claim 1 wherein the bleach is an oxygen bleach and the bleach catalyst is a manganese compound.

6. An automatic dishwashing liquor according to claim 1 wherein the bleach catalyst is a complex of manganese with 1,4,7-trimethyl-1,4,7-triazacyclo-nonane or manganese (II) acetate tetrahydrate.

7. An automatic dishwashing liquor according to claim 1 further comprising carbonate.

8. An automatic dishwashing liquor according to claim 1 further comprising a non-phosphate builder selected from citric acid, MGDA (methyl-glycine-diacetic acid), GLDA (glutamic-N,N-diacetic acid) and mixtures thereof.

9. An automatic dishwashing liquor according to claim 1 further comprising a protease and an amylase.

10. An automatic dishwashing liquor according to claim 1 further comprising a non-ionic surfactant system.

11. An automatic dishwashing liquor according to claim 1 further comprising a zinc salt.

12. An automatic dishwashing liquor according to claim 1 further comprising a second polymer comprising:

i)carboxylic acid monomers;

ii) monomers comprising a sulfonic acid group;

wherein the monomers comprising a sulfonic acid group represent more than 10% on a molar basis of the polymer.

13. A method of washing a dishwashing load in an automatic dishwasher in the presence of orthophosphate, the method comprising the steps of subjecting the load to a dishwashing liquor according to claim 1.

14. A method of washing a dishwashing load in an automatic dishwasher in the presence of orthophosphate, the method comprising the steps of:

1) subjecting the load to wash water comprising from about 0.5 to about 20 ppm of orthophosphate expressed as elementary phosphorous; and 2) providing from about 10 g to about 10 g of an automatic dishwashing composition comprising:
   a) from about 1 to about 15% by weight of the composition of a first polymer comprising:
      i)carboxylic acid monomers;
      ii) monomers comprising a sulfonic acid group; wherein the monomers comprising a sulfonic acid group represent 10% or less of the polymer on a molar basis;
   b) from about 0.5 to about 5% by weight of the composition of a phosphonate;
   c) a bleach system comprising bleach and a bleach catalyst; and
   d) less than 1% of polyphosphate.

15. Use of an automatic dishwashing liquor according to claim 1 to inhibit film formation on plastic items in automatic dishwashing.

* * * * *